US011052524B2

(12) United States Patent
Koizumi

(10) Patent No.: US 11,052,524 B2
(45) Date of Patent: Jul. 6, 2021

(54) HYDRAULIC HAMMERING DEVICE

(71) Applicant: Furukawa Rock Drill Co., Ltd., Tokyo (JP)

(72) Inventor: Masahiro Koizumi, Takasaki (JP)

(73) Assignee: Furukawa Rock Drill Co., Ltd., Tokyo (JP)

( * ) Notice: Subject to any disclaimer, the term of this patent is extended or adjusted under 35 U.S.C. 154(b) by 322 days.

(21) Appl. No.: 15/742,832

(22) PCT Filed: Jul. 7, 2016

(86) PCT No.: PCT/JP2016/070155
§ 371 (c)(1),
(2) Date: Jan. 8, 2018

(87) PCT Pub. No.: WO2017/010400
PCT Pub. Date: Jan. 19, 2017

(65) Prior Publication Data

US 2018/0207782 A1 Jul. 26, 2018

(30) Foreign Application Priority Data

Jul. 13, 2015 (JP) ..... JP2015-139868

(51) Int. Cl.
*B25D 9/26* (2006.01)
*B25D 9/14* (2006.01)
*B25D 9/16* (2006.01)

(52) U.S. Cl.
CPC ..... *B25D 9/26* (2013.01); *B25D 9/145* (2013.01); *B25D 9/16* (2013.01)

(58) Field of Classification Search
CPC . B25D 9/145; B25D 9/14; B25D 9/16; B25D 9/26; B25D 9/12; B25D 9/125; B25D 2209/002
(Continued)

(56) References Cited

U.S. PATENT DOCUMENTS 3,411,592 A * 11/1968 Montabert ..... B25D 9/20 173/207
3,916,764 A * 11/1975 Crover ..... B25D 9/12 91/235
(Continued)

FOREIGN PATENT DOCUMENTS

DE 44 24 080 C1 1/1996
JP S47-013595 B 4/1972
(Continued)

OTHER PUBLICATIONS

Wikipedia entry for "Hydraulic fluid", published online on Jun. 13, 2016, retrieved from URL https://en.wikipedia.org/w/index.php?title=Hydraulic_fluid&oldid=725039375 on Jan. 15, 2020 (Year: 2016).*
(Continued)

*Primary Examiner* — Valentin Neacsu
(74) *Attorney, Agent, or Firm* — Young Basile Hanlon & MacFarlane, P.C.

(57) ABSTRACT

Hammering power of a hydraulic hammering device is improved by shortening a piston stroke, while keeping hammering energy. The device includes a cylinder, a piston slidingly fitted in the cylinder, and a piston front chamber and a piston rear chamber defined between an outer circumferential surface of the piston and an inner circumferential surface of the cylinder and disposed separately from each other at front and rear, respectively, in an axial direction. The device also includes a switching-valve mechanism driving the piston by switching at least one of the piston front or rear chamber into communication with at least one of a high pressure circuit or a low pressure circuit, and an acceleration piston disposed behind the piston and coming in contact with the piston during a retreat stroke of the piston to urge
(Continued)

the piston forward in cooperation with braking force by pressurized oil acting on the piston.

16 Claims, 6 Drawing Sheets

(58) Field of Classification Search
USPC ..... 173/208, 207, 204
See application file for complete search history.

(56) References Cited

U.S. PATENT DOCUMENTS

| | | | | | |
|---|---|---|---|---|---|
| 4,111,269 | A * | 9/1978 | Ottestad | B25D 9/145 | 173/207 |
| 4,172,411 | A * | 10/1979 | Matsuda | B25D 9/12 | 91/278 |
| 4,349,075 | A * | 9/1982 | Henriksson | B25D 9/145 | 173/208 |
| 4,747,455 | A * | 5/1988 | Cunningham | B25C 1/06 | 173/1 |
| 4,951,757 | A * | 8/1990 | Hamada | B25D 9/145 | 173/115 |
| 5,279,120 | A * | 1/1994 | Sasaki | B25D 9/145 | 173/135 |
| 2004/0144551 | A1* | 7/2004 | Koskimaki | B25D 9/18 | 173/1 |
| 2004/0251038 | A1* | 12/2004 | Rantala | B25D 9/18 | 173/207 |
| 2010/0283315 | A1* | 11/2010 | Isono | B60T 8/3655 | 303/9.75 |
| 2014/0209340 | A1* | 7/2014 | Moore | B25D 9/26 | 173/112 |
| 2015/0375383 | A1* | 12/2015 | Autschbach | B25D 9/12 | 173/20 |
| 2016/0039080 | A1* | 2/2016 | Moore | B25D 9/12 | 91/170 R |
| 2017/0001293 | A1* | 1/2017 | Matsuda | B25D 9/145 | |
| 2020/0181978 | A1* | 6/2020 | Koizumi | B25D 9/26 | |

FOREIGN PATENT DOCUMENTS

| | | | |
|---|---|---|---|
| JP | S52-100303 | A | 8/1977 |
| JP | S56-089478 | U | 7/1981 |
| JP | S57-008091 | A | 1/1982 |
| JP | S59-156677 | A | 9/1984 |
| JP | S61-075982 | U | 5/1986 |
| JP | S63-013672 | U | 1/1988 |
| JP | H03-062777 | U | 6/1991 |
| JP | H04-093185 | A | 3/1992 |
| JP | 2000-176859 | A | 6/2000 |
| JP | 2008-036746 | A | 2/2008 |
| JP | 4912785 | B2 | 4/2012 |
| WO | 98/031509 | A1 | 7/1998 |
| WO | 2017/010400 | A1 | 1/2017 |

OTHER PUBLICATIONS

Wikipedia entry for "Hydraulic Fluid", published online on Jul. 12, 2015, retrieved from URL https://en.wikipedia.org/w/index.php?title=Hydraulic_fluid&direction=prev&oldid=672942377 on Jul. 21, 2020 (Year: 2015).*

Definition of "ANOTHER", by Merriam Webster Dictionary, retrieved from URL https://www.merriam-webster.com/dictionary/another on Sep. 15, 2020 (Year: 2020).*

English translation of the International Preliminary Report on Patentability dated Jan. 16, 2018, in International Application No. PCT/JP2016/070155, 7 pp.

Extended European Search Report in corresponding European Patent Application No. 16824380.6, dated Feb. 13, 2019, 6 pgs.

Extended European Search Report in European Patent Application No. 18739319.4, dated Dec. 16, 2019, 7 pgs.

English translation of the International Preliminary Report on Patentability in International Application No. PCT/JP2018/000703, dated Jul. 25, 2019, 10 pgs.

* cited by examiner

HYDRAULIC HAMMERING DEVICE

TECHNICAL FIELD

The present invention relates to a hydraulic hammering device, such as a rock drill and a breaker.

BACKGROUND

Japanese Patent No. 4912785 describes an art disclosed as an example of this type of hydraulic hammering device. The hydraulic hammering device described in the document is provided with a cylinder 100P, a front head 300, and a back head 400P, and a piston 200 slidingly fitted in the cylinder 100P, as illustrated, for example, in FIG. 9.

The front head 300 is disposed in front of the cylinder 100, and a rod 310 is slidingly fitted so as to be movable backwards and forwards. In the front head 300, a hammering chamber 301 is formed, in which the rear end of the rod 310 is hammered by the front end of the piston 200 in the hammering chamber 301. The back head 400P, disposed behind the cylinder 100, includes a retreat chamber 401P formed therein, in which the rear end part of the piston 200 moves backwards and forwards.

The piston 200 is a solid cylindrical body, having large-diameter sections 201 and 202 in an approximately middle region thereof. A medium-diameter section 203 is provided in front of the large-diameter section 201, and a small-diameter section 204 is provided behind the large-diameter section 202. A ring-shaped valve-switching groove 205 is formed in an approximately middle region between the large-diameter sections 201 and 202. The outer diameter of the medium-diameter section 203 of the piston is set larger than that of the small-diameter section 204 of the piston.

As a result, regarding the pressure-receiving areas of the piston 200 in a piston front chamber 110 and that in a piston rear chamber 111, both chambers being described later, in other words, the diametrical difference between the large-diameter section 201 and the medium-diameter section 203 and the diametrical difference between the large-diameter section 202 and the small-diameter section 204, the difference in the piston rear chamber 111 is larger (the difference between the areas will be hereinafter referred to as pressure-receiving area difference).

The piston 200, slidingly fitted in the cylinder 100, defines the piston front chamber 110 and the piston rear chamber 111 within the cylinder 100. The piston front chamber 110 is always connected to a high pressure circuit 101 via a piston front chamber passage 120. On the other hand, the piston rear chamber 111 can communicate with either the high pressure circuit 101 or a low pressure circuit 102 via a piston rear chamber passage 121 by the switching operation of a switching-valve mechanism 130 to be described later.

The high pressure circuit 101 is connected to a pump P, and a high pressure accumulator 140 is provided in the middle of the high pressure circuit 101. The low pressure circuit 102 is connected to a tank T, and a low pressure accumulator 141 is provided in the middle of the low pressure circuit 102. The switching-valve mechanism 130 is a known switching valve disposed in a suitable position inside or outside the cylinder 100P and operates with the aid of pressurized oil supplied/discharged via a valve-control passage 122 to be described later, thereby switching high and low pressures in the piston rear chamber 111 alternatingly.

A piston-advancing control port 112, a piston-retreating control port 113, and an oil-discharging port 114 are provided separately from each other at a certain interval between the piston front chamber 110 and the piston rear chamber 111. The piston-advancing control port 112 and the piston-retreating control port 113 are connected to respective passages branched from the valve-control passage 122. The oil-discharging port 114 is connected to the tank T via an oil-discharging passage 123.

The piston-advancing control port 112 has an anterior short-stroke port 112*a* and a posterior long-stroke port 112*b*, which are used for switching between short stroke and long stroke steplessly by operating a variable throttle 112*c* provided between the short-stroke port 112*a* and the valve-control passage 122. The fully opened variable throttle 112*c* causes a short stroke and the fully closed throttle causes a long stroke.

In this hydraulic hammering device, the piston front chamber 110 is always connected to the high pressure circuit 101, thereby always urging the piston 200 backward; when the piston rear chamber 111 is connected to the high pressure circuit 101 owing to the operation of the switching-valve mechanism 130, the piston 200 advances owing to the pressure-receiving area difference, and when the piston rear chamber 111 is connected to the low pressure circuit 102 owing to the operation of the switching-valve mechanism 130, the piston 200 retreats.

When the piston-advancing control port 112 communicates with the piston front chamber 110 to supply pressurized oil to the valve-control passage 122, the switching-valve mechanism 130 is switched to a position so as to make the piston rear chamber passage 121 communicate with the high pressure circuit 101. In addition, when the piston-retreating control port 113 communicates with the oil-discharging port 114 to discharge pressurized oil from the valve-control passage 122 to the tank T, the switching-valve mechanism 130 is switched to a position so as to make the piston rear chamber passage 121 communicate with the low pressure circuit 102.

BRIEF SUMMARY

Methods of improving the power of this type of hydraulic hammering device include a method for increasing its kinetic energy per stroke and a method for increasing its hammering frequency to increase its total kinetic energy. Between these methods, the present inventor has found the following problem in the method for increasing the hammering frequency to increase its total kinetic energy.

In FIG. 9, a conventional hydraulic hammering device has been explained, which is provided with the piston-advancing control port 112 including both the long-stroke port 112*b* and the short-stroke port 112*a*, and the shortened stroke of the device enables more hammering frequency than in the long-stroke setting thereof.

FIG. 10 illustrates a piston stroke-speed charts for the long stroke and the short stroke of a conventional hydraulic hammering device.

In the figure, the dotted line is a chart for the long stroke setting, and L1 is a whole stroke, L2 is a section for acceleration of retreating piston (after the piston starts retreating until the piston-advancing control port communicates with the piston front chamber and the switched valve switches the piston rear chamber into a high pressure state), L3 is a section for deceleration of retreating piston (after the piston rear chamber is switched into a high pressure state until the piston reaches a backward stroke end), and Vlong is a piston speed at the hammering point. In addition, the solid line is a chart for the short-stroke setting, and also in the dotted line, L1' is a whole stroke, L2' is a section for acceleration of retreating piston, L3' is a section for deceleration of retreating piston, and Vshort is a piston speed at the hammering point.

It can be understood from FIG. 10 that although the short-stroke setting can shorten the stroke, the section for accelerating the piston also decreases, resulting in the decrease of the piston speed from Vlong to Vshort. Accordingly, upon taking as a whole into account the increase in the hammering frequency achieved by the shortened stroke and the decrease in the piston speed, the short-stroke setting does not necessarily lead to the power improvement.

Therefore, the present invention has been made in view of such a problem, and an object thereof is to provide a hydraulic hammering device capable of improving hammering power by shortening its piston stroke, while keeping its hammering energy.

In order to achieve the object mentioned above, according to an aspect of the present invention, there is provided a hydraulic hammering device including: a cylinder; a piston slidingly fitted in the cylinder; a piston front chamber and a piston rear chamber which are defined between an outer circumferential surface of the piston and an inner circumferential surface of the cylinder and disposed separately from each other at front and rear, respectively, in an axial direction of the piston; a switching-valve mechanism driving the piston by switching at least one of the piston front chamber and the piston rear chamber into communication with at least one of a high pressure circuit and a low pressure circuit; and an urging means, which is disposed behind the piston and comes in contact with the piston during a retreat stroke of the piston, to urge the piston forward in cooperation with braking force by pressurized oil acting on the piston.

In the hydraulic hammering device according to the aspect of the present invention, the urging means may come into contact with the piston at a timing of an action of the braking force on the piston owing to pressurized oil during the retreat stroke of the piston.

Further, in the hydraulic hammering device according to the aspect of the present invention, the urging means may be an acceleration piston, thrust of which is generated by pressurized oil supplied from the high pressure circuit.

Further, in the hydraulic hammering device according to the aspect of the present invention, the urging means may be an acceleration piston, the thrust of which is generated by pressure of a gas filled in a closed space.

Accordingly, as to the hydraulic hammering device according to the aspect of the present invention, the urging means is disposed behind the piston and comes in contact with the piston during the retreat stroke of the piston, to urge the piston forward in cooperation with braking force by pressurized oil acting on the piston. Therefore, the retreat stroke of the piston is shortened and the advancing operation of the piston is accelerated, and thus, it is possible to improve the output power since the piston speed does not decrease. Accordingly, the hydraulic hammering device according to the aspect of the present invention can improve hammering power by shortening its piston stroke, while keeping its hammering energy.

The hydraulic hammering device according to the aspect of the present invention may include an operation-selection means for retracting the urging means, when the urging means is not operated, to a position where the urging means is not in contact with the piston.

Further, the switching-valve mechanism may be configured to drive the piston by switching at least the piston rear chamber into communication with either the high pressure circuit or the low pressure circuit alternatingly, and a passage for supplying pressurized oil to the acceleration piston may be branched from a passage for supplying pressurized oil to the piston rear chamber.

The hydraulic hammering device according to the aspect of the present invention may include an urging accumulator provided in the vicinity of the urging means in a passage for supplying pressurized oil from the high pressure circuit to the urging means.

The hydraulic hammering device according to the aspect of the present invention may include a direction-control means, which allows only supply of pressurized oil to the urging means, the direction-control means being provided in the passage for supplying pressurized oil at a position closer to a pressurized-oil-supply than the urging accumulator and in the vicinity of the urging accumulator.

According to the present invention, it is possible to provide a hydraulic hammering device capable of improving hammering power by shortening its piston stroke, while keeping its hammering energy.

DETAILED DESCRIPTION

Hereinafter, respective embodiments of the present invention will be described with reference to the drawings as appropriate. In all of the drawings, the same components are assigned with the same signs. The drawings are schematic. Therefore, it should be noted that a quantity such as the relation or ratio of thickness to surface dimension may be different from the actual one, and the dimensional relation and ratio of parts illustrated in respective drawings may be different from those in another drawing. In addition, each of the embodiments illustrated below exemplifies a device and a method for embodying a technical concept of the present invention, which does not limit the material, shape, structure, arrangement, etc., of component parts to those in embodiments below.

Figure 1:
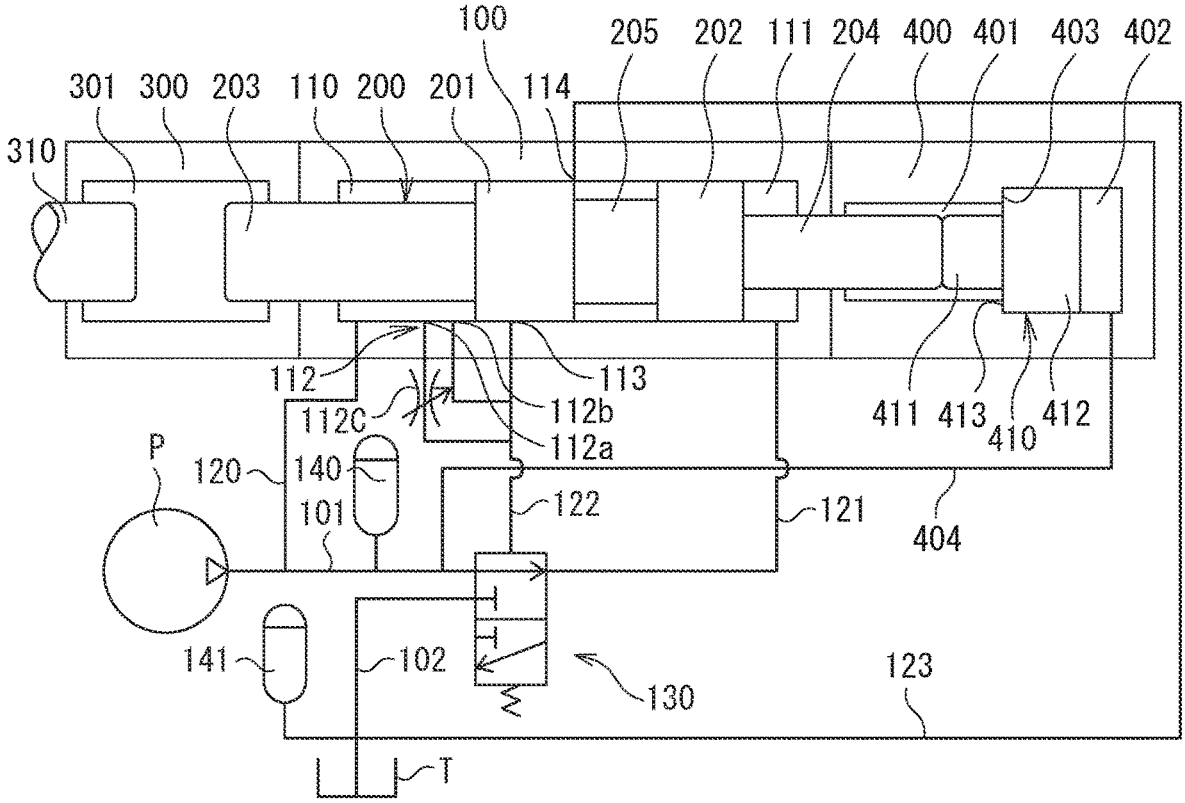
FIG. 1 is a schematic diagram of the first embodiment of a hydraulic hammering device according to an aspect of the present invention.

As illustrated in FIG. 1, the hydraulic hammering device of the first embodiment includes a cylinder 100, a front head 300, a back head 400, and a piston 200 slidingly fitted in the cylinder 100.

The piston 200 is a solid cylindrical body, having large-diameter sections 201 and 202 in an approximately middle region thereof. The piston has a medium-diameter section 203 provided in front of the large-diameter section 201 and a small-diameter section 204 provided behind the large-diameter section 202. A ring-shaped valve-switching groove 205 is formed in an approximately middle region between the large-diameter sections 201 and 202.

The outer diameter of the medium-diameter section 203 of the piston is set larger than that of the small-diameter section 204 of the piston. As a result, regarding the pressure-receiving area of the piston 200 in a piston front chamber 110 and that in a piston rear chamber 111, in other words, the diametrical difference between the large-diameter section 201 and the medium-diameter section 203 and the diametrical difference between the large-diameter section 202 and the small-diameter section 204, the difference in the piston rear chamber 111 is larger.

The piston 200 is slidingly fitted in the cylinder 100, thereby defining the piston front chamber 110 and the piston rear chamber 111 within the cylinder 100. The piston front chamber 110 is always connected to a high pressure circuit 101 via a piston front chamber passage 120. On the other hand, the piston rear chamber 111 can communicate alternatingly with either the high pressure circuit 101 or a low pressure circuit 102 via the piston rear chamber passage 121 by switching a switching-valve mechanism 130 to be described later.

A pump P is connected to the high pressure circuit 101, in the middle of which is provided a high pressure accumulator 140. A tank T is connected to the low pressure circuit 102, in the middle of which is provided a low pressure accumulator 141. The switching-valve mechanism 130 is a known switching valve disposed in a suitable position inside or outside the cylinder 100 and is operated by pressurized oil supplied/discharged via a valve-control passage 122 to be described later, thereby switching high and low pressures in the piston rear chamber 111 alternatingly.

A piston-advancing control port 112, a piston-retreating control port 113, and an oil-discharging port 114 are provided separately from each other at a certain interval between the piston front chamber 110 and the piston rear chamber 111. The piston-advancing control port 112 and the piston-retreating control port 113 are connected to respective passages branched from the valve-control passage 122. The oil-discharging port 114 is connected to the tank T via an oil-discharging passage 123.

The piston-advancing control port 112 includes an anterior short-stroke port 112*a* and a posterior long-stroke port 112*b*. Regarding the piston-advancing control port 112, short stroke and long stroke can be steplessly switched by operating a variable throttle 112*c* provided between the short-stroke port 112*a* and the valve-control passage 122. The fully opened variable throttle 112*c* causes a short stroke and the fully closed throttle causes a long stroke.

In front of the cylinder 100, a front head 300 is disposed, in which a rod 310 is slidingly fitted so as to be movable backwards and forwards. The front head 300 includes a hammering chamber 301 formed therein, in which the rear end of the rod 310 is hammered by the front end of the piston 200.

A back head 400 is disposed behind the cylinder 100. The back head 400 includes a retreat chamber 401 and a pressurizing chamber 402 behind the retreat chamber, both formed therein. The inner diameter of the retreat chamber 401 is set so as not to influence the backward and forward movement of the small-diameter section 204 of the piston, and the inner diameter of the pressurizing chamber 402 is set to be larger than that of the retreat chamber 401. The end surface 403 is formed on the boundary between the retreat chamber 401 and the pressurizing chamber 402.

An acceleration piston 410 as an urging means is slidingly fitted to the pressurizing chamber 402. The acceleration piston 410 has an anterior small-diameter section 411 and a posterior large-diameter section 412. A stepped surface 413 is formed on the boundary between the small-diameter section 411 and the large-diameter section 412. The large-diameter section 412 slidingly coming into contacting with the inner diameter of the pressurizing chamber 402 and the end surface 403 coming into contact with the stepped surface 413 form a hydraulic chamber behind the large-diameter section 412 in the pressurizing chamber 402, and the hydraulic chamber is always connected to the high pressure circuit 101 via the pressurizing passage 404.

In general hydraulic hammering devices, the hammering surface of the rod 310 and that of the piston 200, in other words, the outer diameter of the medium-diameter section 203 of the piston and the outer diameter of the rear end part of the rod 310 are set to be of the same size. The reason for this is to enhance the transmission efficiency of stress wave generated by the rod 310 struck by the piston 200, and for the same reason in this embodiment, the outer diameter of the small-diameter section 411 of the acceleration piston 410 is set to be nearly of the same size as that of the small-diameter section 204 of the piston.

Next, the operation of the hydraulic hammering device of this embodiment and operating states of the acceleration piston 410 will be explained with reference to FIGS. 2A to 2D. In FIGS. 2A to 2D, regions to which the circuit is connected in a highly-pressurized state are indicated by thick solid lines and hatching.

In the hydraulic hammering device of this embodiment, the piston front chamber 110 is always connected in a highly pressurized state, thereby always urging the piston 200 backward; when the piston rear chamber 111 is connected in the highly pressurized state owing to the operation of the switching-valve mechanism 130, the piston 200 advances owing to the pressure-receiving area difference. When the piston rear chamber 111 is connected in a low pressurized state owing to the operation of the switching-valve mechanism 130, the piston 200 retreats.

When the piston-advancing control port 112 communicates with the piston front chamber 110 to supply pressurized oil to the valve-control passage 122, the switching-valve mechanism 130 is switched to a position such that the piston rear chamber passage 121 communicates with the high pressure circuit 101. When the piston-retreating control port 113 communicates with the oil-discharging port 114 to discharge pressurized oil to the tank T from the valve-control passage 122, it is switched to a position such that the piston rear chamber passage 121 communicates with the low pressure circuit 102. The setting of the piston-advancing control port is for long stroke wherein the variable throttle 112*c* is fully closed.

Here, the hammering mechanism of hydraulic hammering device of this embodiment is characterized in that the acceleration piston 410 is provided in the back head 400 in comparison with conventional hydraulic hammering devices.

Figures 2A, 2B, 2C, 2D:
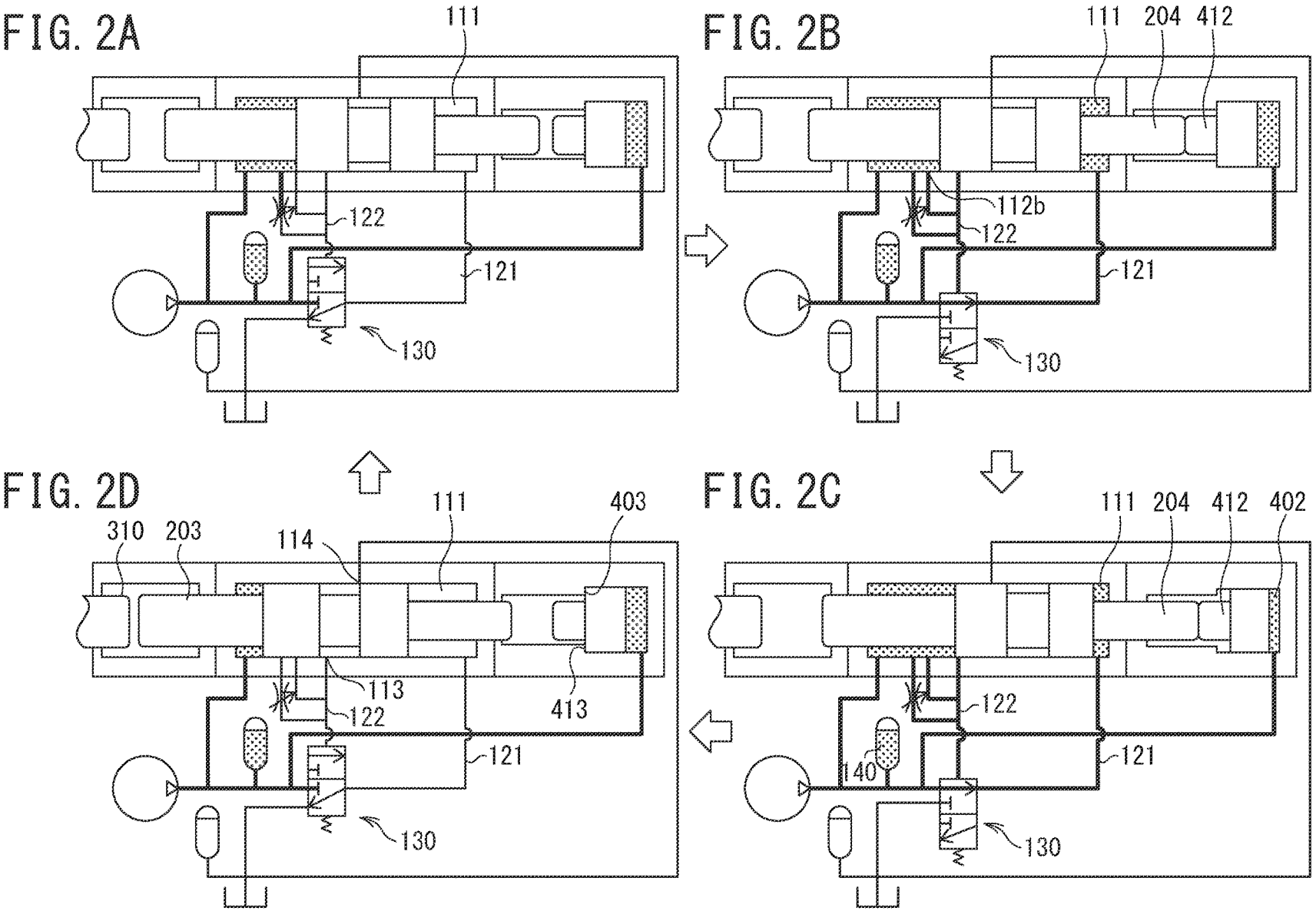
FIGS. 2A to 2D are schematic diagrams indicating operating states of the first embodiment.

In other words, upon the hammering of the rod 310 by the piston 200, as illustrated in FIG. 2D, a pilot chamber (not illustrated) of the switching-valve mechanism 130 is connected to a low pressure state via the valve-control passage 122 and the oil-discharging passage 123, and thereby the internal spool of the pilot chamber is switched so that the piston rear chamber passage 121 communicates with the low pressure circuit 102, to make the piston rear chamber 111 be in the low pressure state, resulting in the start of the retreat operation of the piston 200 (See FIG. 2A).

When the piston 200 retreats, the piston-advancing control port 112 is opened to switch the switching-valve mechanism 130, and at the timing when the piston rear chamber 111 enters the high pressure state, the piston 200 comes into contact with the acceleration piston 410. At this time, the piston 200 receives the action of the thrust ('additional thrust') owing to the acceleration piston 410 in addition to the thrust (referred to as 'normal thrust') owing to the pressure-receiving area difference between the piston front chamber 110 and the piston rear chamber 111 (See FIG. 2B). In other words, the acceleration piston 410 comes into contact with the piston 200 during the retreat stroke of the piston 200, to apply the additional thrust to the piston 200, the thrust urging the piston 200 forward in cooperation with the normal thrust (braking force) by pressurized oil acting on the piston 200.

Then, the piston 200, still continuing retreating by its inertia, turns from retreat to advance at a position anterior to the usual backward stroke end owing to the additional thrust together with the normal thrust acting on the piston 200. In the meantime, pressurized oil discharged from the pressurizing chamber 402 is pressurized into the high pressure accumulator 140 (See FIG. 2C).

Immediately after the piston 200 turned to advance, the pressurized oil accumulated in the high pressure accumulator 140 is supplied to the pressurizing chamber 402. Therefore, the piston 200 is urged to be accelerated rapidly by the acceleration piston 410. Eventually, when the stepped surface 413 comes into contact with the end surface 403 and reaches the forward stroke end of the acceleration piston 410, the piston 200 moves forward apart from the acceleration piston 410 only with the aid of normal thrust and hammers the rod 310 (See FIG. 2D). Then, the cycle above is repeated.

Figure 3:
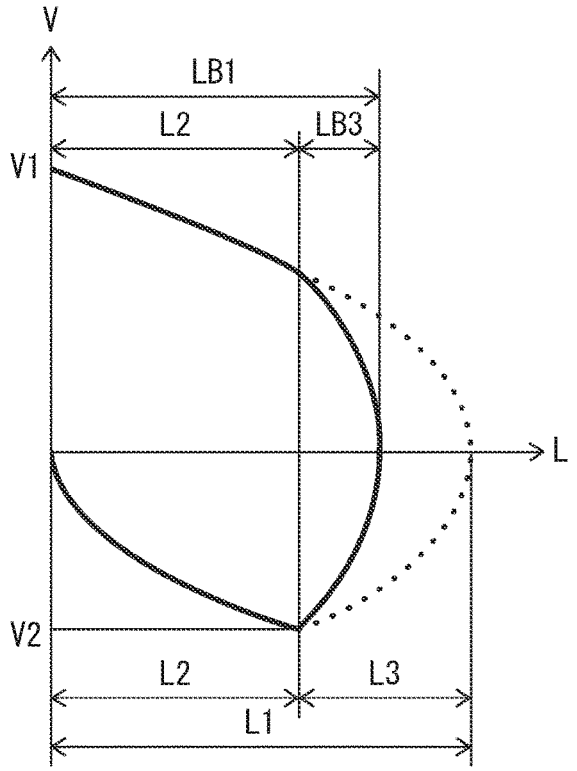
FIG. 3 is a piston stroke-speed chart of the first embodiment.

FIG. 3 illustrates a piston stroke-speed chart in the hydraulic hammering device of this embodiment. In this figure, a reference is also illustrated by a dashed line, which is a case without the acceleration piston 410 of this embodiment.

In FIG. 3, the time period from the retreat of the piston 200 to the contact thereof with the acceleration piston 410 (FIGS. 2A to 2B) corresponds to the region of V<0 in the L2 section, the time period from the contact of the piston 200 with the acceleration piston 410 to the retreat thereof to the backward stroke end (FIG. 2C) corresponds to the region of V<0 in the LB3 section, the time period from the turning of the piston 200 to advance to the separation thereof from the acceleration piston 410 corresponds to the region V>0 in the LB3 section, and the time period from the separation to the hammering of the rod 310 by the piston 200 advancing with the aid of the normal thrust (FIG. 2D) corresponds to the region of V>0 in the L2 section.

Figure 10:
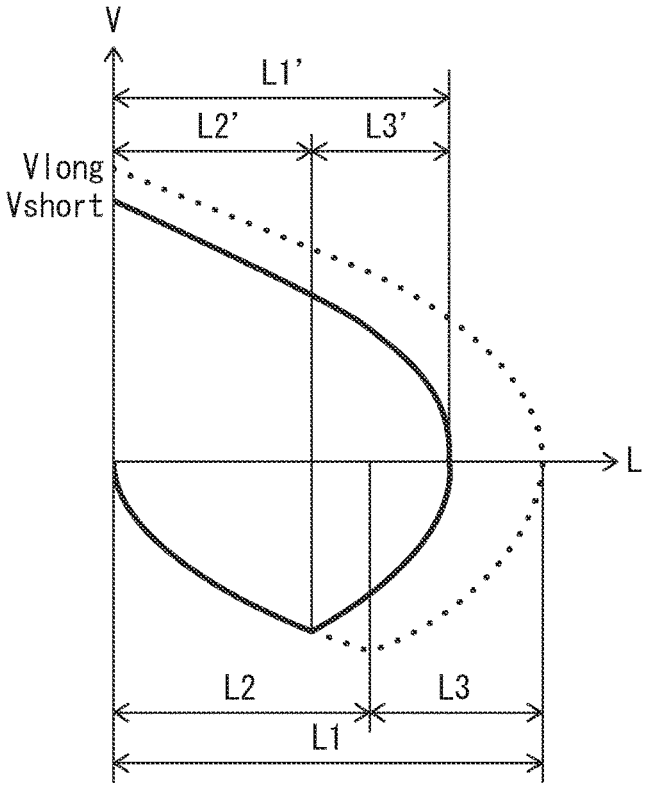
FIG. 10 (PRIOR ART)
FIG. 10 is a piston stroke-speed chart of the conventional hydraulic hammering device.

In this instance, the conventional piston stroke-speed chart without the acceleration piston 410 has the same profile as that of the chart for the long stroke in FIG. 10, displayed by a dotted line as with the case in FIG. 10, with respective strokes represented by L1 to L3.

As illustrated in FIG. 3, the hydraulic hammering device of this embodiment operates as a hammering mechanism specified as a long-stroke type except in the section during which the piston 200 is in contact with the acceleration piston 410, and it can be seen that there is no change for the speed V1 upon the hammering of the rod 310 by the piston 200 and the maximum speed V2 during the retreat of the piston.

In other words, a difference caused by the presence or absence of the acceleration piston 410 of this embodiment is only the stroke in the section during which the piston 200 is in contact with the acceleration piston 410, and the stroke in this section is shortened from L3 to LB3. Therefore, the overall stroke is shortened from L1 to LB1.

Thus, the acceleration piston 410 of this embodiment can be said to be a mechanism which transiently enlarges the pressure-receiving area of the piston rear chamber 111 only during a part of the piston-retreating stroke, in other words, during the stroke of the LB3 section which is from decelerated retreat via backward-stroke end to accelerated advance.

The pressure-receiving area, enlarged during the decelerated retreat of the piston 200, causes the increase of braking force, which will stop the retreat operation of the piston 200 in a short time. Simultaneously, the time required for accumulating pressurizing oil into the high pressure accumulator 140 is shortened, which oil is discharged from the piston rear chamber 111 and the pressurizing chamber 402.

Then, even after the piston 200 turned to advancing operation, the pressure-receiving area is kept enlarged, thereby shortening the time required for releasing the pressurized oil accumulated in the high pressure accumulator 140 to be supplied to the piston rear chamber 111 and the pressurizing chamber 402, resulting in increase in the advance acceleration of the piston 200.

Thus, it is understood that, according to the hydraulic hammering device of this embodiment, the stroke is shortened by shortening the time for recovery/release of kinetic energy by the high pressure accumulator 140, as compared with hydraulic hammering devices without the acceleration piston 410.

The mass of the piston is represented by $m_p$, and that of the acceleration piston 410 by $m_b$. For conventional hydraulic hammering devices in the retreat-deceleration stroke during which the piston 200 reduces its velocity from the speed $V_2$ in the L3 section of FIG. 3 to zero, when the force by the high pressure accumulator 140 acting on the piston 200 is defined as $F_p$ and the duration of the action as $T_p$, the impulse acting on the piston 200 and the change in the momentum satisfy $$-mV_pV_p=F_p\cdot T_p$$

On the other hand, for the hydraulic hammering device of the present invention provided with an additional acceleration piston in the retreat-deceleration stroke during which the piston 200 reduces the velocity from the speed V2 in LB3 section in FIG. 3 to zero, when force with which the high pressure accumulator 140 acts on the piston 200 and the accelerating piston 410 during this stroke is defined as $F_b$, and the duration of the action as $T_b$, the impulse acting on the piston 200 and the piston 410 and the change in the momentum satisfy $$(m_p+m_b)V_p=F_b\cdot T_b,$$

where, substituting $m_b=a\cdot m_p$ into the above relation gives $$-(m_p+m_b)V_p=-(1+a)m_p\cdot V_p=(1+a)F_p\cdot T_p=F_b\cdot T_b,$$

$$\therefore T_b=(1+a)(F_p/F_b)T_p.$$

Further, when the pressure-receiving area difference between the piston front chamber 110 and the piston rear chamber 111 for the piston 200 is defined as $A_p$, the pressure-receiving area of the large-diameter section 412 of the acceleration piston 410 defined as $A_b$, and the hydraulic pressure defined as $\Delta P$, they give $$F_p=A_p\cdot\Delta P,$$

$$F_b=(A_p+A_b)\Delta P,$$

$$\therefore T_b=(1+a)A_p/(A_p+A_b)T_p.$$

For comparison, time required for the advance-acceleration stroke in the L3 section of the conventional hydraulic hammering device and that required for advance-acceleration stroke in the LB3 section of the hydraulic hammering device of the present invention are also represented by $T_p$ and $T_b$, respectively.

In other words, the hydraulic hammering device of the present invention shortens its stroke because the cycle time 2 $T_b$ in LB3 section during which the piston 200 comes in contact with the acceleration piston 410, stops owing to braking, then turns to advance, and accelerates is related to the cycle time 2 $T_p$ in the L3 section of conventional hydraulic hammering machines with no acceleration piston 410, by a relation of 2 (1+a) $A_p/(A_p+A_b)$ $T_p$. In addition, the smaller mass ratio a of the acceleration piston 410 to the piston 200 and the larger pressure-receiving area $A_b$ of the accelerating piston 410 facilitates a shortened stroke more.

This shortened stroke necessitates no additional power because it is achieved through recovery/release of kinetic energy by the high pressure accumulator 140. Further, when an actual hammering device is designed, the mass ratio a of the acceleration piston 410 to the piston 200 is preferably designed to be negligibly small, in other words, the mass $m_b$ of the acceleration piston 410 is preferably set to be as small as possible.

In the hydraulic hammering device of this embodiment, there is no change for the speed V1 of the piston 200 upon hammering the rod 310 even when the shortened stroke is achieved. Therefore, the hammering frequency is increased without decreasing hammering energy per stroke, thereby enabling improvement in the power of the hammering mechanism.

Figure 4:
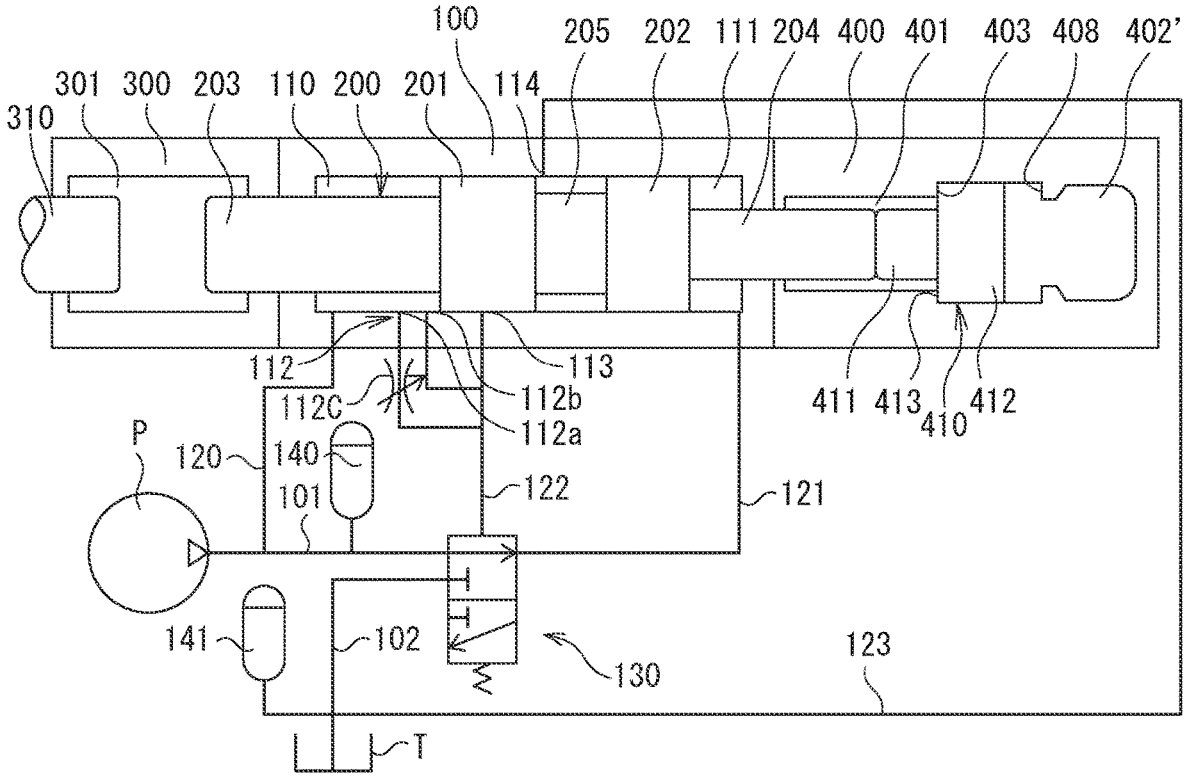
FIG. 4 is a schematic diagram of the second embodiment of the hydraulic hammering device according to an aspect of the present invention.

Next, the second embodiment of the present invention will be explained with reference to FIG. 4. In this figure, the configurations same as or corresponding to those described in the first embodiment above are assigned with the same or corresponding signs (with a dash), and the description thereof will be omitted appropriately (hereinafter, the same is true in other embodiments).

As illustrated in the figure, in this second embodiment, the pressurizing chamber 402' is different from that in the first embodiment described above in that a closed space is formed by the back head 400 and the large-diameter section 412 of the acceleration piston 410.

In the second embodiment, a pressurizing chamber 402' is filled with highly pressurized gas, the pressure of which adds a forward thrust to the acceleration piston 410. The retreat stroke of the acceleration piston 410 is limited by a ring-shaped end surface 408. Other configurations are the same as those in the first embodiment.

According to this the second embodiment, no hydraulic circuit is required for urging means, thereby enabling simplifying the configuration of the hydraulic hammering device.

Next, the third embodiment of the present invention will be explained with reference to FIG. 5.

As illustrated in the figure, the back head 400 in this third embodiment includes a partition wall 405 formed anterior to the boundary between the retreat chamber 401 and the pressurizing chamber 402 (i.e., end surface 403), the partition wall having an inner diameter slidingly fitted to the outer diameter of the small-diameter section 411 of the acceleration piston, and a switching chamber **405*a* provided on the partition wall 405 facing the pressurizing chamber 402. The switching chamber 405*a* is connected to a switching passage 406, which together with the pressurizing passage 404 is designed to communicate with any one of the high pressure circuit 101 and the low pressure circuit 102 via the switching-valve mechanism 420**. Other configurations are the same as those in the first embodiment.

Figure 5:
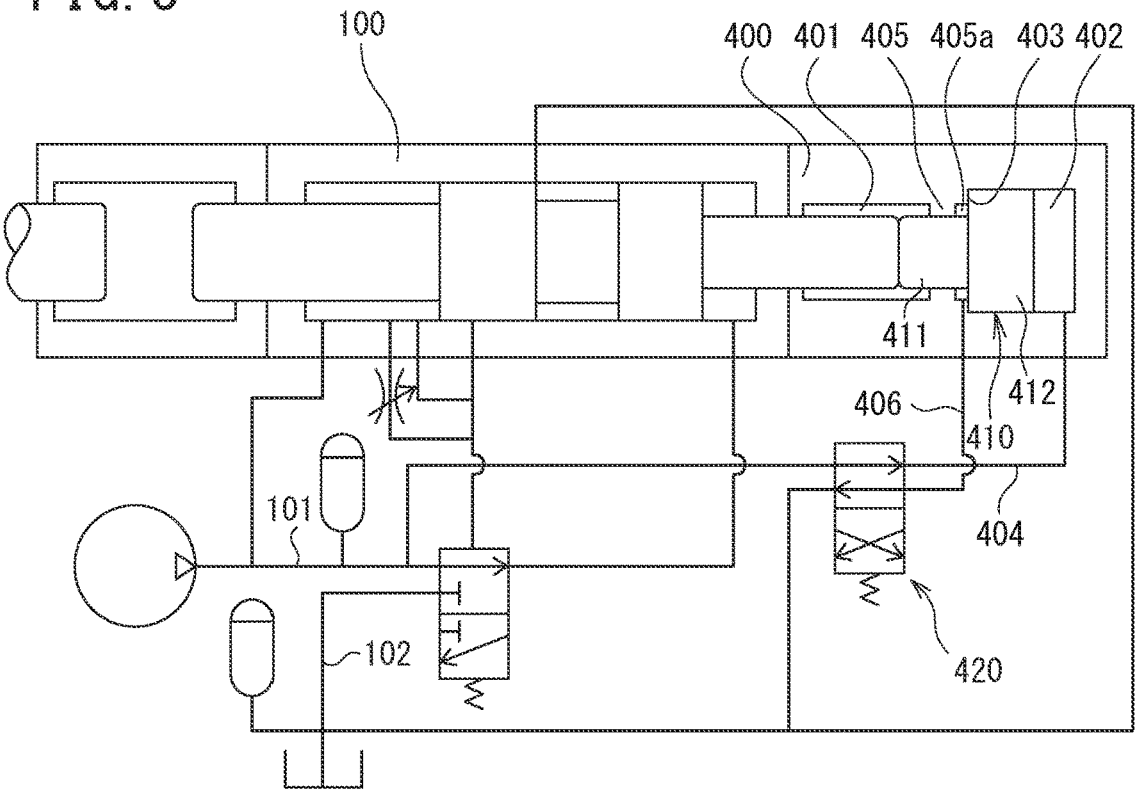
FIG. 5 is a schematic diagram of the third embodiment of the hydraulic hammering device according to an aspect of the present invention.

According to this third embodiment, the switching-valve mechanism 420, when in a state of position illustrated in FIG. 5, can make the acceleration piston 410 operate as described above, to achieve the shortened stroke of the hammering mechanism. In contrast, when the switching-valve mechanism 420 is switched from the upper state illustrated in FIG. 5 to the lower state illustrated in FIG. 5, the pressurized oil is supplied to the switching chamber **405*a*, and therefore, the hammering mechanism can be made to operate in a normal stroke in such a way that the acceleration piston 410 retracts to the backward stroke end not to come in contact with the piston 200. In other words, this additional component part of the modified example functions as operation-selection means (on/off switch) for the acceleration piston 410**.

Next, the fourth embodiment of the present invention will be explained with reference to FIG. 6.

In the fourth embodiment, as illustrated in this figure, the pressurizing chamber 402 is connected to the piston rear chamber passage 121 via a pressurizing passage 407. Other configurations are the same as those in the first embodiment.

According to this fourth embodiment, the pressurizing passage 407 which is a passage for supplying pressurized oil to the acceleration piston 410 is provided in such a way as to be branched from the piston rear chamber passage 121 supplying pressurized oil to the piston rear chamber 111, and therefore, supply/discharge of pressurized oil to/from both pressurizing chamber 402 and the piston rear chamber 111 is performed synchronously. Therefore, the timing at which the acceleration piston 410 described above starts operating can be made to exactly coincide with the timing of the start of retreat-deceleration stroke of the piston 200. Therefore, energy is never wasted by the collision of the piston 200 with the acceleration piston 410 before the piston 200 starts decelerating.

Next, the fifth embodiment of the present invention will be explained with reference to FIG. 7.

As illustrated in this figure, the fifth embodiment includes an urging accumulator 142 provided in the vicinity of the pressurizing chamber 402 in the pressurizing passage 404' connecting the pressurizing chamber 402 and the high pressure circuit 101. Other configurations are the same as those in the first embodiment.

In the hydraulic hammering device of the first embodiment illustrated in FIG. 1, for example, the piston 200 comes into contact with the acceleration piston 410 during its retreat stroke and is urged by the cooperation of the braking force by pressurized oil acting on the piston 200 and the forward thrust acting on the acceleration piston 410, and thereby the shortened piston stroke is achieved. Therefore, when the piston 200 comes in contact with the acceleration piston 410, a shock occurs.

Therefore, in the hydraulic hammering device of the first embodiment, when the piston 200 retreats and collides with the acceleration piston 410, the impact propagating to the pressurizing passage 404 via pressurized oil in the pressurizing chamber 402 reaches the switching-valve mechanism 130. The switching-valve mechanism 130, affected by the impact of pressurized oil, may cause the operational instability of the switching-valve mechanism 130.

Figure 7:
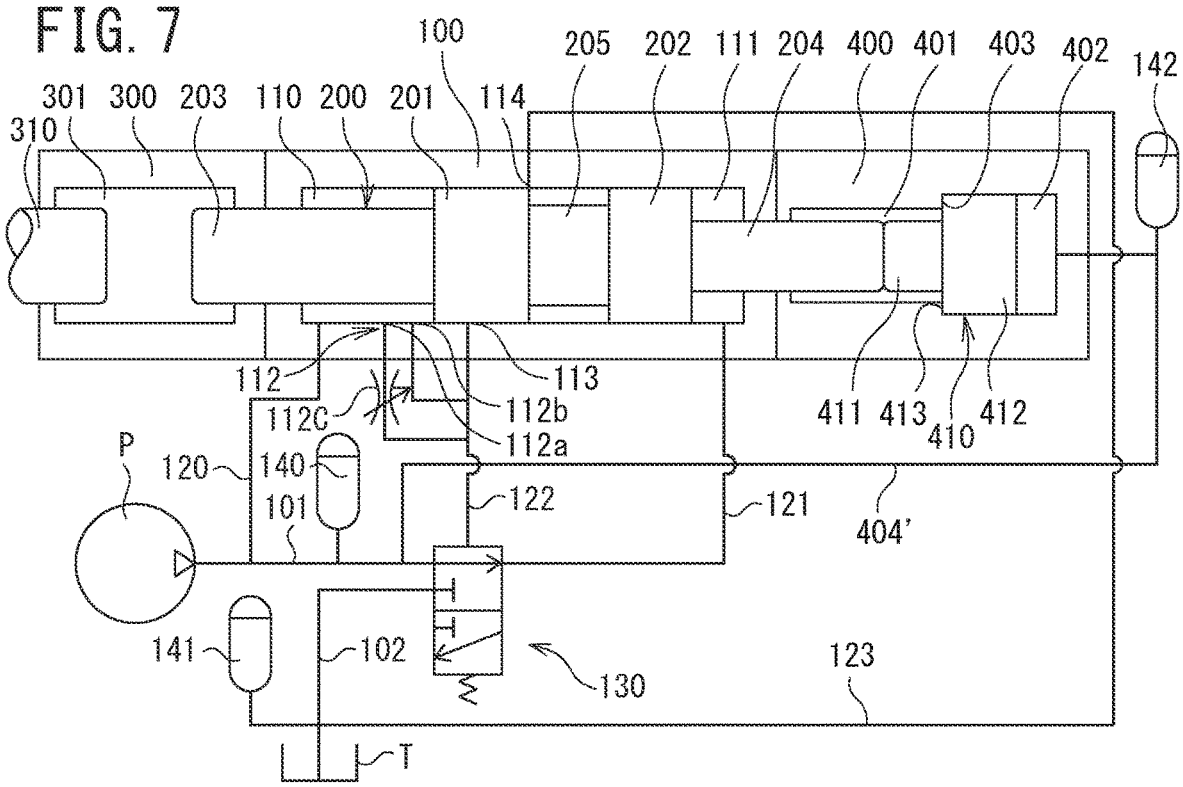
FIG. 7 is a schematic diagram of the fifth embodiment of the hydraulic hammering device according to an aspect of the present invention.

On the other hand, in this fifth embodiment, as illustrated in FIG. 7, the urging accumulator 142 is provided closer to the pressurizing chamber 402 than the high pressure accumulator 140. When the piston 200 collides with the acceleration piston 410 and the impact propagates to pressurized oil in the pressurizing chamber 402, the urging accumulator 142 reduces the shock more effectively than the high pressure accumulator 140. Therefore, the operation of the switching-valve mechanism 130 will not be affected adversely. In addition, when the volume of the pressurizing chamber 402 suddenly fluctuates owing to the displacement of the acceleration piston 410, the urging accumulator 142 can absorb/release an amount of oil corresponding to the fluctuation, at a lower conduit resistance than the high pressure accumulator 140 does.

Next, the sixth embodiment of the present invention will be explained with reference to FIG. 8.

In all of the hydraulic circuits, a larger passage area causes lower pressure loss and improves hydraulic efficiency. When attention is drawn to the relation of the passage area of the high pressure passage 121 and the pressure-receiving area of the piston rear chamber 111 and the relation of the passage area of the pressurizing passage 404 and the pressure receiving area of the pressurizing chamber 402 in the hydraulic hammering device of the first embodiment illustrated in FIG. 1, it can be seen that, on condition that the passage area of the high pressure passage 121 and that of the pressurizing passage 404 are set to be the same, the ratio of the passage area to the pressure-receiving area is smaller for the pressurizing passage 404.

Smaller passage area in comparison to pressure-receiving area means larger pressure loss. In other words, it can be said that the pressurizing passage 404 has a relatively larger pressure loss with respect to the high pressure passage 121. Thus, in the first embodiment, the pressure loss in the acceleration piston 410 is relatively large, and therefore, possibly insufficient to exert the acceleration action of the present invention when the piston 200 and the acceleration piston 410 move together, but increasing the passage area as a solution for this concern is limited both in terms of costs and arrangement.

Figure 8:
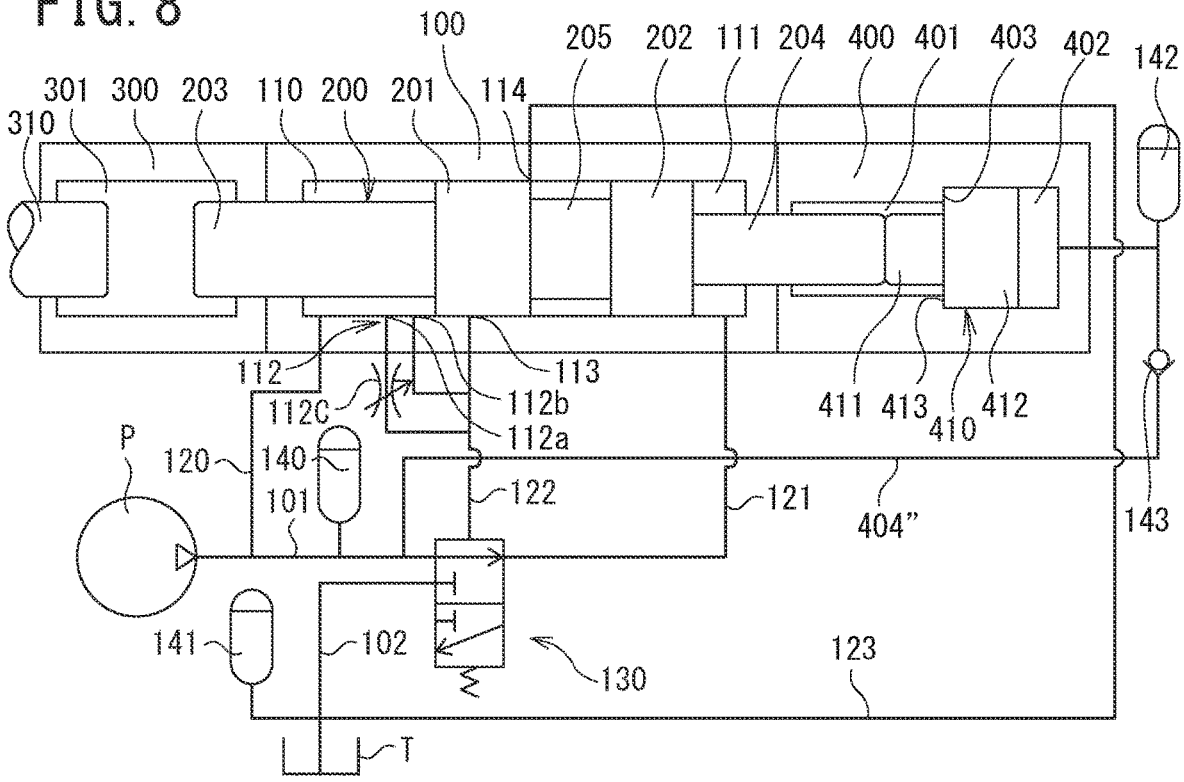
FIG. 8 is a schematic diagram of the sixth embodiment of the hydraulic hammering device according to an aspect of the present invention.
Figure 9:
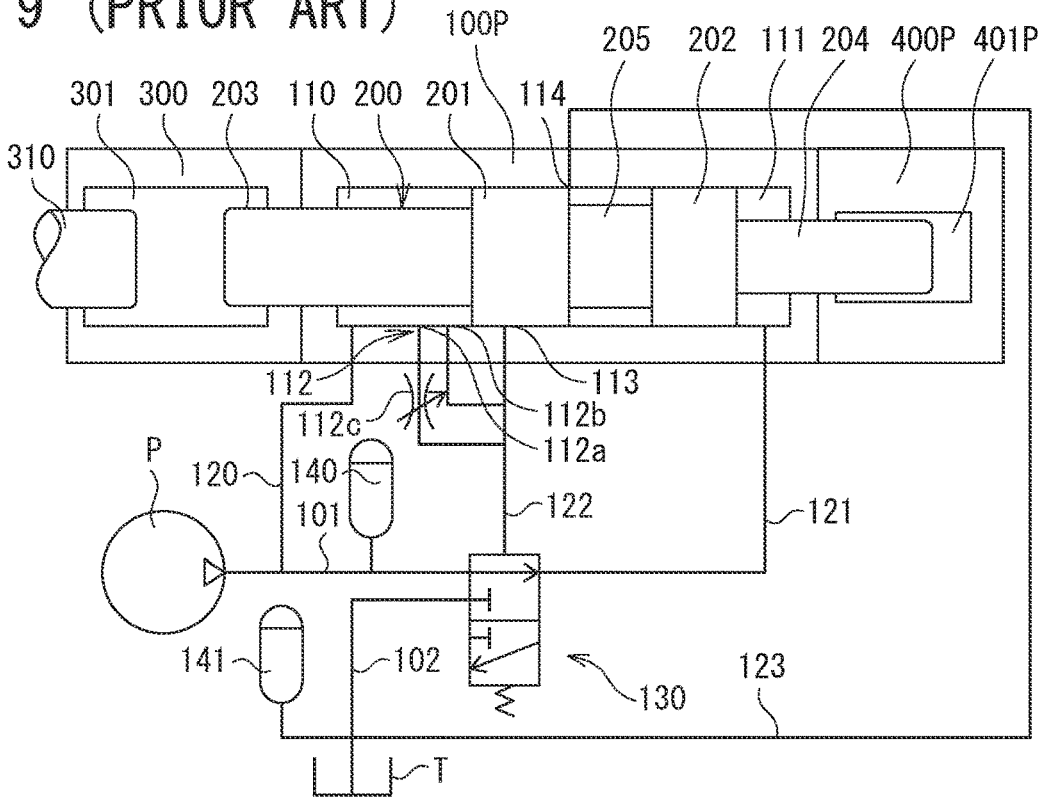
FIG. 9 (PRIOR ART)
FIG. 9 is a schematic diagram of a conventional hydraulic hammering device.

Thus, in this the sixth embodiment, as illustrated in FIG. 8, the pressurizing chamber 402 and the high pressure circuit 101 are connected to each other by a pressurizing passage 404", which is provided with the urging accumulator 142 in the vicinity of the pressurizing chamber 402, and in addition, a check valve 143 on the upstream side of the urging accumulator 142 (i.e., on the side of pump P which is a source of pressurized oil), the check valve serving as a direction-control means that allows only supply of pressurized oil to the pressurizing chamber 402. Other configurations are the same as those in the first embodiment.

According to the sixth embodiment, providing the check valve 143 enables preventing the backflow of oil to the pressurizing passage 404", improving the utilization efficiency of the urging accumulator 142 drastically. Therefore, the urging accumulator 142 can play a more positive role as a source of pressurized oil for exerting the acceleration action of the present invention. Therefore, the pressure loss may not be taken into account for the pressurizing passage 404", and the passage area can be made small. In addition, the improved utilization efficiency of the urging accumulator 142 owing to the check valve 143 also enables achieving the aforementioned impact-reduction effect against pressurized oil in the pressurizing chamber 402.

As described above, each of the embodiments of the present invention has been described with reference to drawings, but there is no need to say that the hydraulic hammering device according to the present invention is not limited to the embodiments, and other variants and various modification of each of the components can be carried out as long as they do not depart from the spirit of the present invention.

For example, the piston is not limited to solid one and a through-hole or a stop hole may be formed at the axial central part of the piston. Further, the anterior and posterior large-diameter sections of the piston may not be of the same diameter and may have a diametrical difference from each other. Still further, the outer diameter of the small-diameter section of the acceleration piston may not be fitted to the outer diameter of the medium-diameter section of the piston. Still further, the timing at which the piston comes into contact with the acceleration piston may be slightly varied with respect to the timing at which the piston rear chamber is switched into the high pressure state.

In addition, the hydraulic hammering devices according to the embodiments were exemplified by a hydraulic hammering device of so-called a 'rear chamber high/low pressure switching type' which makes the piston advance/retract by switching high and low pressures in the piston rear chamber while always keeping high pressure in the piston front chamber, but it is not limited to this type.

In other words, the hydraulic hammering device according to the present invention is applicable not only to a hydraulic hammering device of so-called a 'front/rear chamber high/low pressure switching type' which makes the piston advance/retract by alternatingly switching high pressure and low pressures in the piston front chamber and the piston rear chamber, respectively, but also to a hydraulic hammering device of so-called a 'front chamber high/low pressure switching type' which makes the piston advance/retract by switching high and low pressures in the piston front chamber while always keeping high pressure in the piston rear chamber.

Figure 6:
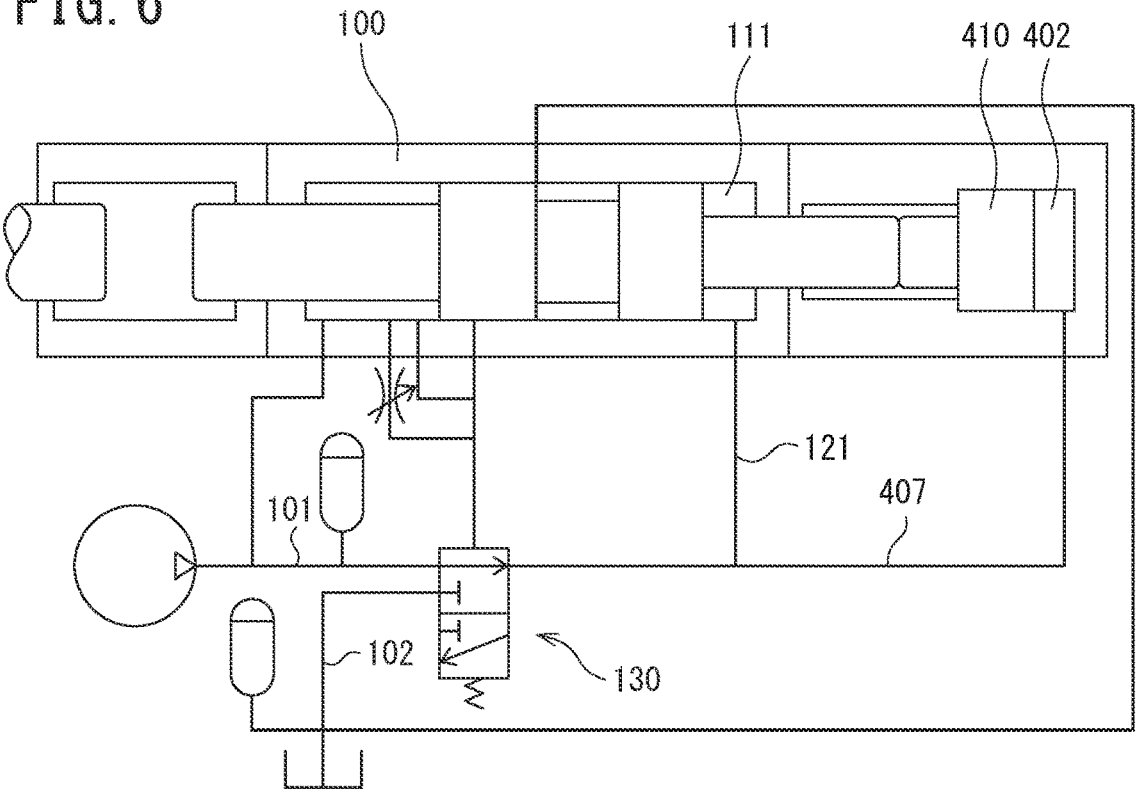
FIG. 6 is a schematic diagram of the fourth embodiment of the hydraulic hammering device according to an aspect of the present invention.

Regarding the hydraulic hammering device of the fourth embodiment illustrated in FIG. 6, only when it is applied to a hydraulic hammering device of the 'rear chamber high/low pressure switching type' or the 'front/rear chamber high/low pressure switching type' which switches high and low pressures in the piston rear chamber, it exerts its function synchronized with the piston rear chamber which is a resultant operational effect.

A list of reference signs used in the drawing figures is below.

100 cylinder
101 high pressure circuit
102 low pressure circuit
110 piston front chamber
111 piston rear chamber
112 piston-advancing control port
**112*a*** short-stroke port

112*b* long-stroke port
112*c* variable throttle
113 piston-retreating control port
114 oil-discharging port
120 piston front chamber passage
121 piston rear chamber passage
122 valve-control passage
123 oil-discharging passage
130 switching-valve mechanism
140 high pressure accumulator
141 low pressure accumulator
142 urging accumulator
143 check valve (direction-control means)
200 piston
201 large-diameter section (anterior)
202 large-diameter section (posterior)
203 medium-diameter section
204 small-diameter section
205 valve-switching groove
300 front head
301 hammering chamber
310 rod
400 back head
401 retreat chamber
402 pressurizing chamber
402' pressurizing chamber
404', 404" pressurizing passage
403 end surface
404 pressurizing passage
405 partition wall
405*a* switching chamber
406 switching passage
407 pressurizing passage
410 acceleration piston (urging means)
411 small-diameter section
412 large-diameter section
413 stepped surface
420 switching-valve mechanism
P pump
T tank

The invention claimed is:

1. A hydraulic hammering device comprising:

a cylinder;

a piston slidingly fitted in the cylinder;

a piston front chamber and a piston rear chamber which are defined between an outer circumferential surface of the piston and an inner circumferential surface of the cylinder and disposed separately from each other at front and rear, respectively, in an axial direction of the piston;

a switching-valve mechanism driving the piston by switching at least one of the piston front chamber and the piston rear chamber into communication with at least one of a high pressure circuit and a low pressure circuit; and an urging unit including a solid body that slidingly fits into a pressurizing chamber disposed behind the piston, the pressurizing chamber including a pressurized oil that acts directly on a surface of the solid body, and the solid body configured to come in contact with the piston by thrust generated by the pressurized oil during a retreat stroke of the piston to urge the piston forward in cooperation with braking force by the pressurized oil acting on the piston.

2. The hydraulic hammering device according to claim 1, wherein the urging unit comes into contact with the piston at a timing of an action of the braking force on the piston owing to pressurized oil during the retreat stroke of the piston.

3. The hydraulic hammering device according to claim 2, wherein the urging unit is an acceleration piston, thrust of which is generated by pressurized oil supplied from the high pressure circuit.

4. The hydraulic hammering device according to claim 3, comprising an operation-selection unit for retracting the urging unit, when the urging unit is not operated, to a position where the urging unit is not in contact with the piston.

5. The hydraulic hammering device according to claim 3, wherein the switching-valve mechanism is configured to drive the piston by switching at least the piston rear chamber into communication with either the high pressure circuit or the low pressure circuit alternatingly, and a passage for supplying pressurized oil to the acceleration piston is branched from a passage for supplying pressurized oil to the piston rear chamber.

6. The hydraulic hammering device according to claim 3, comprising an urging accumulator provided in a vicinity of the urging unit in a passage for supplying pressurized oil from the high pressure circuit to the urging unit.

7. The hydraulic hammering device according to claim 6, comprising a direction-control unit which allows only supply of pressurized oil to the urging unit, the direction-control unit being provided in the passage for supplying pressurized oil at a position closer to a pressurized-oil-supply than the urging accumulator and in a vicinity of the urging accumulator.

8. The hydraulic hammering device according to claim 2, wherein the urging unit is an acceleration piston, thrust of which is generated by pressure of a gas filled in a closed space.

9. The hydraulic hammering device according to claim 2, comprising an operation-selection unit for retracting the urging unit, when the urging unit is not operated, to a position where the urging unit is not in contact with the piston.

10. The hydraulic hammering device according to claim 1, wherein the urging unit is an acceleration piston, thrust of which is generated by pressurized oil supplied from the high pressure circuit.

11. The hydraulic hammering device according to claim 10, wherein the switching-valve mechanism is configured to drive the piston by switching at least the piston rear chamber into communication with either the high pressure circuit or the low pressure circuit alternatingly, and a passage for supplying pressurized oil to the acceleration piston is branched from a passage for supplying pressurized oil to the piston rear chamber.

12. The hydraulic hammering device according to claim 10, comprising an urging accumulator provided in a vicinity of the urging unit in a passage for supplying pressurized oil from the high pressure circuit to the urging unit.

13. The hydraulic hammering device according to claim 12, comprising a direction-control unit which allows only supply of pressurized oil to the urging unit, the direction-control unit being provided in the passage for supplying pressurized oil at a position closer to a pressurized-oil-supply than the urging accumulator and in a vicinity of the urging accumulator.

14. The hydraulic hammering device according to claim 10, comprising an operation-selection unit for retracting the urging unit, when the urging unit is not operated, to a position where the urging unit is not in contact with the piston.

15. The hydraulic hammering device according to claim 1, wherein the urging unit is an acceleration piston, thrust of which is generated by pressure of a gas filled in a closed space.

16. The hydraulic hammering device according to claim 1, comprising an operation-selection unit for retracting the urging unit, when the urging unit is not operated, to a position where the urging unit is not in contact with the piston.

* * * * *